US006736098B2

(12) United States Patent
Toedter et al.

(10) Patent No.: US 6,736,098 B2
(45) Date of Patent: May 18, 2004

(54) METHOD AND DEVICE FOR CONTROLLING THE HEATING OF THE GLOW PLUGS IN A DIESEL ENGINE

(75) Inventors: Olaf Toedter, Wossingen (DE); Günther Uhl, Helmstadt-Bargen (DE); Heinz-Georg Schmitz, Marbach (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 10/201,571

(22) Filed: Jul. 24, 2002

(65) Prior Publication Data

US 2003/0029405 A1 Feb. 13, 2003

(30) Foreign Application Priority Data

Jul. 24, 2001 (DE) ..... 101 35 880

(51) Int. Cl.[7] ..... F02B 9/08
(52) U.S. Cl. ..... 123/145 A; 123/179.6
(58) Field of Search ..... 123/145 A, 406.55, 123/406.7, 145 R, 143 A, 179.21, 179.6

(56) References Cited

U.S. PATENT DOCUMENTS 4,196,712 A * 4/1980 Kawamura et al. ..... 123/179.6
4,240,392 A * 12/1980 Matayoshi et al. ..... 123/145 A
5,367,994 A * 11/1994 Hinkle ..... 123/145 A
5,469,819 A * 11/1995 Berger et al. ..... 123/179.6
5,862,786 A * 1/1999 Fuchs et al. ..... 123/142.5 E

FOREIGN PATENT DOCUMENTS

DE 38 35 214 A1 5/1989
DE 199 49 498 A1 4/2001

OTHER PUBLICATIONS

MTZ Motortechnische Zeitschrift, Instant Start Systems (ISS), The Electronically Controlled Glow System for Diesel Engines, 61 (2000) 10, pp. 1–8.

* cited by examiner

*Primary Examiner*—Mahmoud Gimie
(74) *Attorney, Agent, or Firm*—Nixon Peabody LLP; David S. Safran

(57) ABSTRACT

A method and device for controlling the heating of the glow plugs in a diesel engine, wherein the engine temperature is determined, independently of initialization of the engine control system and following a signal for starting the engine, by a sensor communicating with the glow control system. A glow command is generated if the engine temperature is below a predetermined value. Commencement of the heating procedure is automatically determined by the glow control system independently of initialization of the engine control system, and heating of the glow plugs can start prior to completion of initialization of the engine control system. The time required for the completion of initialization of the engine control system can be saved during heating of the glow plugs.

8 Claims, 2 Drawing Sheets

METHOD AND DEVICE FOR CONTROLLING THE HEATING OF THE GLOW PLUGS IN A DIESEL ENGINE

BACKGROUND OF THE INVENTION

1. Field of the Invention

The invention relates to a method and a device for controlling the heating of the glow plugs in a diesel engine. Such a method and such a device are used to bring the glow plugs to a predetermined set point temperature at which the engine can be started.

2. Description of Related Art

The publication MTZ 10/2000 "Das elektronisch gesteuerte Glühsystem ISS für Dieselmotoren" [The electronically controlled glow system ISS for diesel engines] discloses a method for controlling the heating of glow plugs in a diesel engine. The glow command or glow requirement is issued after engine control initialization has been completed and after the temperature of the engine elements has been determined by way of the engine control system and subsequent successful establishment of communication between the engine control system and the glow control device.

Since the engine control system in the above method can issue a glow command to the glow control device only after completion of initialization, activation of the glow plugs, i.e., commencement of heating of the glow plugs, is delayed until the engine control system is initialized and the command is transmitted. Therefore, a considerable amount of time elapses before the first successful ignition operations of the engine occurs.

One proposed alternative is to use opening of the doors of a diesel engine vehicle as a start signal for heating the glow plugs. However, this method is often disadvantageous because opening the doors often has no connection with starting of a desired engine. Consequently, the number of heating processes of the glow plugs is unnecessarily increased and the service life of the glow plugs is shortened.

SUMMARY OF THE INVENTION

In view of the foregoing, it is an object of the present invention to provide a method and device for controlling the heating of the glow plugs in a diesel engine, wherein the time required for heating the glow plugs can be reduced.

In the present invention, any necessary heating of the glow plugs starts immediately after receipt of a signal for starting the engine, e.g., after switching on the ignition, and after the engine temperature has been determined and evaluated to form a glow command. Therefore, since there is no need to wait for completion of initialization of the engine control system and determination of the temperature is carried out by the glow control system independently of the engine control system, the time required for heating the glow plugs can typically be reduced, for example, by 500 ms.

A preferred embodiment of the present invention is described below with reference to the associated drawings.

DETAILED DESCRIPTION OF THE INVENTION

Figure 1:
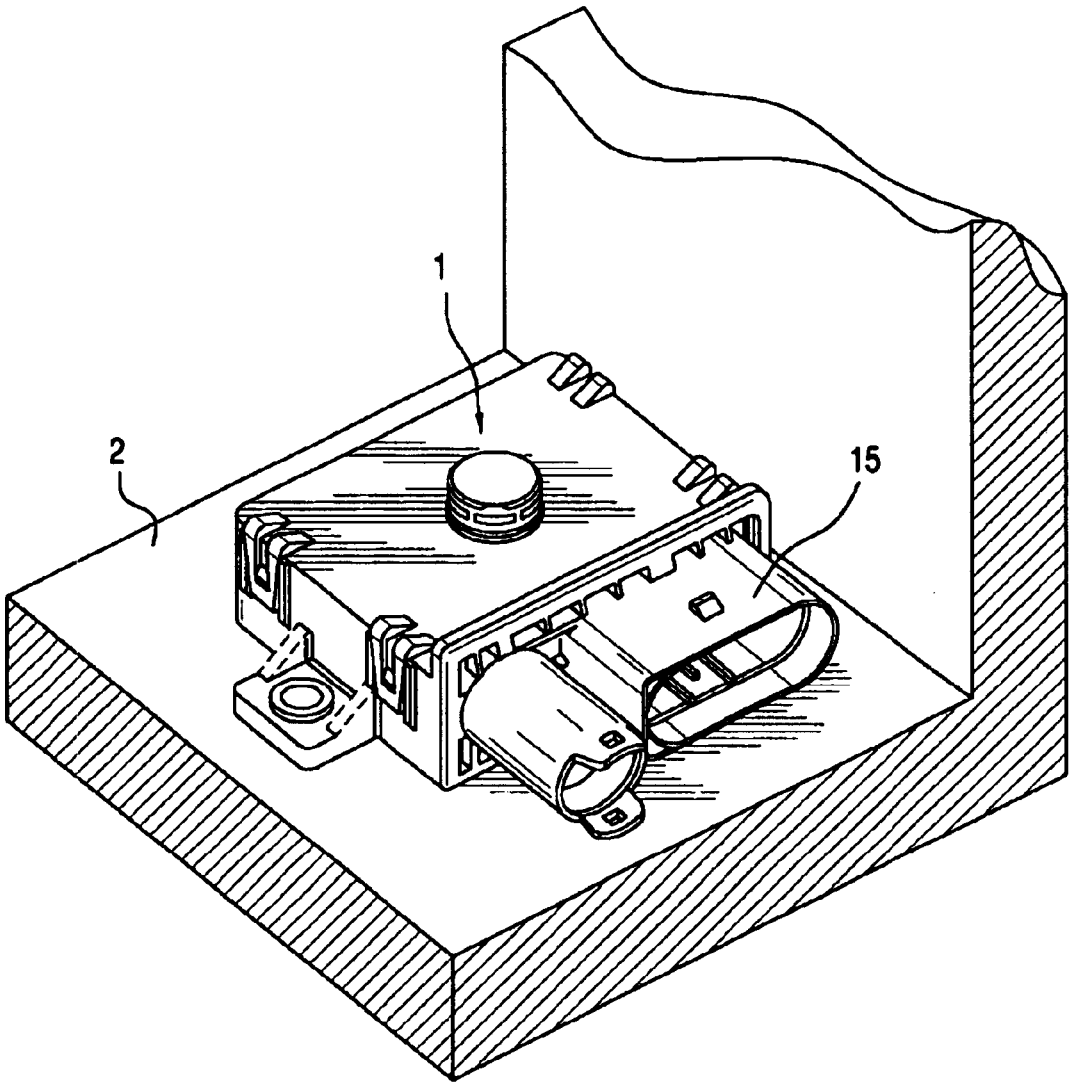
FIG. 1 is a perspective view of the arrangement of a glow control device in the engine compartment of a diesel engine.
Figure 3:
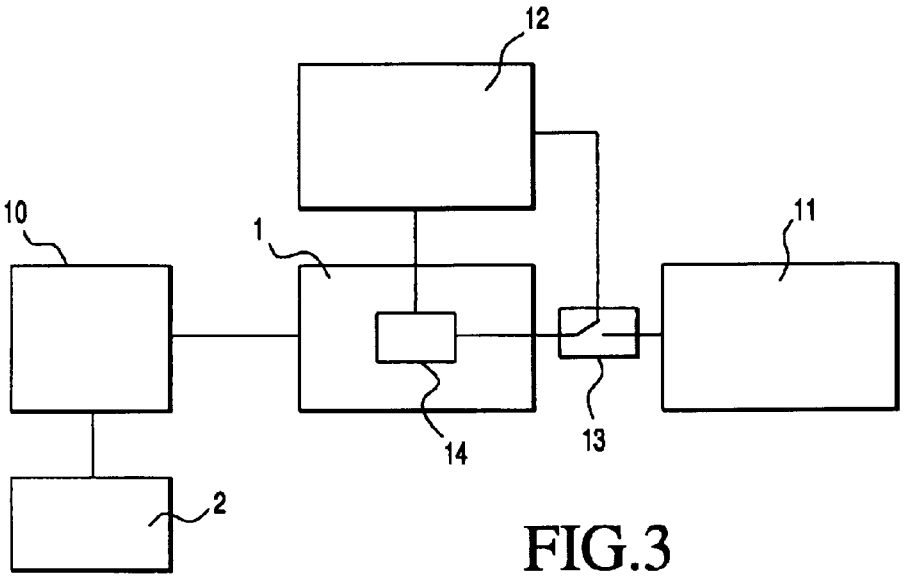
FIG. 3 is a circuit diagram of one embodiment of the device according to the invention.

As shown in FIG. 1, the device according to the present invention comprises a glow control system 1 which generates a glow command for heating the glow plugs when the engine temperature is below a specified value. An internal temperature sensor 10, shown in FIG. 3, provided in the glow control system 1 determines the engine temperature. The temperature sensor 10 senses the temperature of a support of the glow control circuit, which is the same as the temperature of a contact surface, such as the bottom plate of the housing of the glow control system 1. The glow control system 1 can also be arranged directly at the engine block 2, so as to be thermally connected to the engine. Therefore, the output signal of the temperature sensor 10 corresponds to the engine temperature.

Depending on this temperature value, the glow control system 1 independently determines whether or not to start heating the glow plugs.

As an alternative to the use of an internal temperature sensor, an external temperature sensor can be affixed in a corresponding location in the engine compartment such that the engine temperature can be determined. In this case, the output signal of the external temperature sensor is at the glow control system. However, it is preferable to use an internal temperature sensor due to the good thermal coupling between the glow control system and the engine coupling and the cost savings over an external sensor and its cabling.

Operation of the device for controlling the heating of the glow plugs commences when a start signal is present, e.g., when the engine ignition is switched on. Therefore, heating of the glow plugs in a cold engine can start during the initialization period of the engine control system. Electrical supply of the glow control system 1 is provided by a respective connection, for example, terminal 15, wherein the voltage present can be interpreted as a start signal. However, it is also possible to use a dedicated start signal which is generated when the ignition is switched on.

If a start signal is present and the engine temperature determined by the sensor 10 is below a specified value, e.g., 5° Celsius, heating is automatically triggered by the glow control system. A dedicated start signal, or the fact that a voltage is present at the supply terminal to the glow control system 1, ensures that the heating of the glow plugs 11 starts only if starting of the engine is indeed intended.

Figure 2:
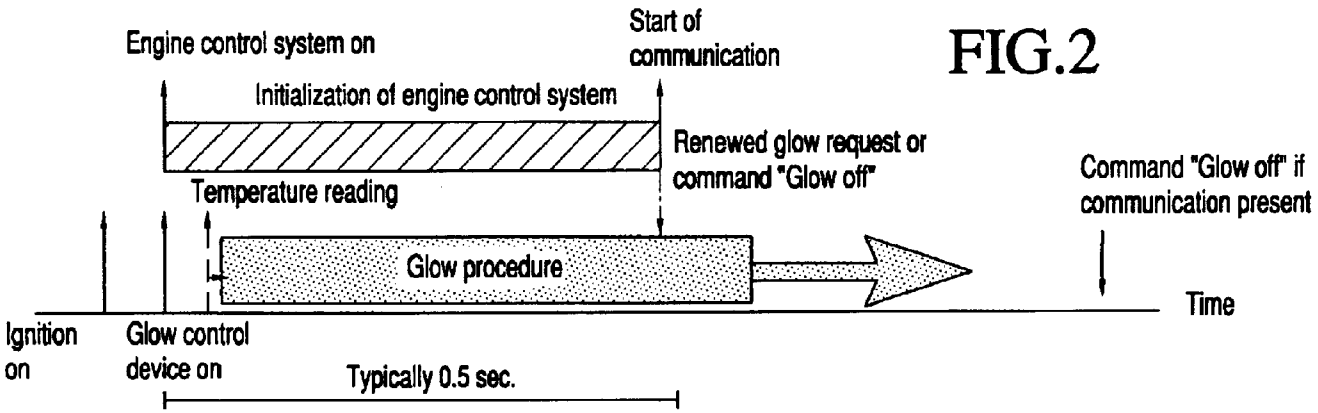
FIG. 2 is a time-dependency diagram of an example of the method according to the invention.

As shown in FIG. 2, in a time-dependency diagram, heating of the glow plugs 11 by the glow control system 1 automatically starts if the engine temperature determined by the temperature sensor 10 fails to reach the specified value of, for example, 5° Celsius, and if a start signal is present. Thus, the heating process already starts during the initialization phase of the engine control system 12, since determination of the temperature takes significantly less time than initialization of the engine control system 12.

As is further shown in FIGS. 2 and 3, control of heating of the glow plugs 11 is taken over by the engine control system following the successful completion of initialization of the engine control system 12 and as soon as communication between the engine control system 12 and the glow control system 1 has been established. Heating of the glow plugs 11 is then either terminated or defined by commands issued by the engine control system 12. If it was not possible to successfully complete the initialization of the engine control system 12 or if no communication to the glow control system 1 was established, the heating process is automatically terminated after a predetermined amount of time. A respective changeover element 13 is provided for changing over between controlling heating by the glow control system 1 and the engine control system 12. Termination of heating the glow plug 11 after a given time interval is controlled by the respective time function element 14.

Preferably, to optimize engine start after establishing communication between the engine control system 12 and the glow control system 1, the current state of the glow plugs 11 is fed-back to the engine control system 12. The engine control system 12 then decides, after taking into account other factors, whether to trigger an engine start or wait until the glow plugs 11 have reached a certain temperature, for example, 800° Celsius.

For example, the driver of a vehicle can initiate an engine start signal by switching the ignition on with the ignition key. However, this signal can also be generated in some other way. For example, this signal can be formed by a voltage present at the supply connection for activating the engine starter motor, the engine control system 12, and other components. However, it can also be a dedicated start signal which is present at the engine control system 12, the glow control system 1, and further components. The signal is then evaluated and, after completion of checking routines, a starting procedure which matches the current state of the engine is carried out. The starting signal is not only present at the engine control system 12 but also at the glow control system 1. The glow control system 1 is initialized as a result and subsequently senses the current engine temperature either by way of an internally installed temperature sensor 10 or by way of an external temperature sensor 10 which can be installed in the engine block 2, so as to be in contact with the coolant. If an internal temperature sensor 10 is used, it is advantageous to establish good thermal coupling between the glow control system and the engine. This can be done by affixing the metal bottom plate of the glow control system 1 to the engine block 2. If the engine temperature is lower than its value specified in the glow control system, the glow control system 1 immediately initiates heating of the glow plugs 11. While current is already applied to the glow plugs 11, the engine control system 12 is initialized at the same time so that after completion of the checking routines, it initiates fuel injection or starting of the engine.

Typically, it takes about 300 to 500 ms longer for initialization of the engine control system 12 than it does for initialization of the glow control system 1. This time can thus be saved during heating of the glow plugs. On completion of initialization of the engine control system 12, the engine control system 12 can communicate with the glow control system 1 and transmit further commands for heating the glow plugs 11. Furthermore, it is possible to examine the state of the glow plugs 11 and, for example, to only initiate starting of the engine by the engine control system 12 if the glow plugs 11 have safely exceeded a set temperature, for example, 800° Celsius. In this way, the starting behavior can be optimized in relation to starting time, pollutant emission, etc. If no further command arrives from the engine control system 12 when a start signal is present, the glow control system 1 can switch the heating of the glow plugs 11 off again after a set period, for example, 20 seconds, such period having been specified in the glow control system.

With the method and device according to the present invention, the time which passes until the first successful ignition of the diesel engine during cold start can be shortened when using a glow control system 1, and, in particular, during direct starting of the engine without explicit preheating. During this time, the vehicle's electrical system is only exposed to loads resulting from heating of the glow plugs 11 and, if applicable, from the starter motor. As a result of the quick reduction of the power requirement in the case of a glow system with self-regulating glow plugs, the vehicle electrical system is relieved during the start phase. Furthermore, starting with the ignition key allows a less pollutant emission because less uncombusted fuel is present in the exhaust gas stream. The service life of the glow plugs can be extended by minimizing the heating processes. Furthermore, from the perspective of starter motor release, the starting of the engine can only be optimized after a certain temperature has been reached. If the engine is not to be started via the ignition key or if such a request is suppressed after starting the engine, then heating of the glow plugs can be carried out in a more moderate way with the time gained.

What is claimed is:

1. A device for controlling the heating of the glow plugs in a diesel engine having an engine control system, comprising:

a temperature sensor which senses the engine temperature independent of the engine control system; and a glow control system which generates a glow command for heating the glow plugs if engine temperature sensed by said temperature sensor is below a predetermined value and a signal indicating the starting of the engine has been received;

wherein a changeover device is provided which is responsive to the completion of the initialization of the engine control system for commencing communication between the engine control system and the glow control system so as to control the glow command with the engine control system instead of the glow control system.

2. The device according to claim 1, wherein the temperature sensor is arranged for sensing the temperature of a support of the glow control circuit which is in thermal contact with the engine.

3. The device according to claim 1, wherein an external temperature sensor which is separate from the glow control system is provided.

4. The device according to claim 1, wherein a time function element is provided for canceling the glow command after a specified time interval has lapsed if there is no communication between the engine control system and the glow control system.

5. A device for controlling the heating of the glow plugs in a diesel engine having an engine control system, comprising:

a temperature sensor which senses the engine temperature independent of the engine control system; and a glow control system which generates a glow command for heating the glow plugs if engine temperature sensed by said temperature sensor is below a predetermined value and a signal indicating the starting of the engine has been received;

wherein an external temperature sensor which is separate from the glow control system is provided; and wherein a changeover device is provided which is responsive to the completion of the initialization of the engine control system for commencing communication between the engine control system and the glow control system so as to control the glow command with the engine control system instead of the glow control system.

6. The device according to claim 5, wherein a time function element is provided for canceling the glow command after a specified time interval has lapsed if there is no communication between the engine control system and the glow control system.

7. A device for controlling the heating of the glow plugs in a diesel engine having an engine control system, comprising:

a temperature sensor which senses the engine temperature independent of the engine control system; and a glow control system which generates a glow command for heating the glow plugs if engine temperature sensed by said temperature sensor is below a predetermined value and a signal indicating the starting of the engine has been received:

wherein the temperature sensor is arranged for sensing the temperature of a support of the glow control circuit which is in thermal contact with the engine; and wherein a changeover device is provided which is responsive to the completion of the initialization of the engine control system for commencing communication between the engine control system and the glow control system so as to control the glow command with the engine control system instead of the glow control system.

8. The device according to claim 7, wherein a time function element is provided for canceling the glow command after a specified time interval has lapsed if there is no communication between the engine control system and the glow control system.

* * * * *